United States Patent [19]

Coiner

[11] 4,094,434

[45] June 13, 1978

[54] DISPOSABLE CONTAINER FOR HEATABLE FOOD PRODUCTS

[76] Inventor: William A. Coiner, 101 S. Indian Cir., Cocoa, Fla. 32922

[21] Appl. No.: 749,888

[22] Filed: Dec. 13, 1976

[51] Int. Cl.[2] ..... A47G 19/22; B65D 25/28

[52] U.S. Cl. ..... 220/90.6; 220/94 A; 426/115; 426/135

[58] Field of Search ..... 426/113, 109, 123, 135, 426/115, 114; 215/12 R, 13 R; 220/90.2, 90.4, 90.6, 270, 1 BC, 9 F, 94 R, 85 H, 94 A

[56] References Cited

U.S. PATENT DOCUMENTS

| | | | |
|---|---|---|---|
| 2,115,654 | 4/1938 | Swofford | 215/13 R |
| 2,614,406 | 10/1952 | Carpenter | 220/90.6 |
| 2,759,337 | 8/1956 | Katz | 215/13 R |
| 2,981,984 | 5/1961 | Orr | 215/13 R |
| 3,179,286 | 4/1965 | Morceau | 220/94 R |
| 3,204,805 | 9/1965 | May | 220/90.2 |
| 3,257,025 | 6/1966 | Jolly | 220/90.2 |
| 3,507,418 | 4/1970 | Saunders | 220/270 |
| 3,510,022 | 5/1970 | Heller | 220/270 |
| 3,765,561 | 10/1973 | Hekal et al. | 220/270 |
| 3,766,975 | 10/1973 | Todd | 215/12 R |
| 3,891,116 | 6/1975 | Schane | 220/270 |
| 3,976,795 | 8/1976 | Ando | 426/123 |

*Primary Examiner*—William Price
*Assistant Examiner*—Allan N. Shoap
*Attorney, Agent, or Firm*—Roger L. Martin

[57] ABSTRACT

A disposable container with a hermetically sealed chamber in which perishable foods are stored is equipped with a removable closure and a brim or lip that rises above closure and is covered with insulating material that facilitates the direct consumption of a hot food product from the container. The brim surrounds a removable closure of the tear away top type. One embodiment has a recessed side wall portion located adjacent to closure end which is covered with insulating material to facilitate the manipulation of the container when the contents are heated. In another embodiment, the insulating material extends below the lip and the recess appears in the covering insulating material. The heat insulating material is all located at the upper end of the container and except for indicia imprinted on the side wall, the container is generally barren of overlay material below the recessed area to facilitate the heating of the contents.

2 Claims, 7 Drawing Figures

DISPOSABLE CONTAINER FOR HEATABLE FOOD PRODUCTS

BACKGROUND OF THE INVENTION

The invention relates to disposable containers for food products and more particularly to containers of the kind contemplated which can be used for the merchandising display, heating and subsequent human consumption of the contained product.

The use of metal containers for the storage and merchandising display of heatable food products is well known. Many people have a need or desire to use the storage container when heating the food product to the desired temperature and frequently have the need or desire to consume the heated product directly from the container. A typical situation where the need or desire arises is when a person is in a wilderness area, as on a hike for business or recreational purposes and where separate heating and eating utensils merely add to the weight of the baggage that must be packed into the area by the person.

The desire to use the display container for the heating and direct consumption of heatable food products also prevails in some households and where the cleaning of heating and eating utensils is preferably avoided by the product consumer or sometimes rendered inconvenient because of lack of modern household water facilities.

A problem with the current prior art disposable containers for heatable food products lies in the fact that the food product can either not be heated in the disposable container because of the materials of construction or, alternatively, if heated, cannot be consumed directly from the container by the consumer because the container is at that point too hot to manipulate directly with the fingers much less to encounter the consumer's lips in the direct consumption of the product.

SUMMARY OF THE INVENTION

In accord with the invention, the inventor provides a metal container with a removable closure which is surrounded by a lip that rises above the closure. The inventor covers the inside and outside surfaces of the lip with heat insulating material that restricts the heat transfer from the metal parts of the container. The arrangement provides a brim or lip for the container that generally rises above the location of the removable closure so that the lips of a consumer can encounter the brim in the consumption of the heated food product without discomfort.

To facilitate the finger manipulation of the container when the contents have been heated, the inventor provides a recessed area in the peripheral side wall of the container and which surrounds the removable closure. The outer surface of the recessed area is also covered with insulating material so as to facilitate finger manipulation of the container without discomfort when the contents are heated. The recess is arranged to accomodate the consumer's fingers in manipulating the container and provides an area during the heating of the container contents that is inset from the heat that arises along the side wall of the container during the heating process. In accord with certain aspects the covering insulating material may be adapted to provide the recess as will be subsequently seen and except for indicia used in the merchandising display of the contained product the balance of the container is uncovered so as to be readily adaptable to the heating process.

A general objective of the invention is to provide a container which is disposable and which can be used in the merchandising display of the contents as well as in the heating and direct consumption of the food product in and from the container.

Yet another objective is to provide a disposable container for preserving food products and which may be used in the heating of the contents and subsequent direct consumption of the heated food product contained therein.

Still another object is to provide a disposable container that can be used for the heating and direct consumption of the contained product without the need for using additional utensils.

Other objectives will be apparent from the disclosure which follows.

DESCRIPTION OF THE PREFERRED EMBODIMENT

Figure 1:
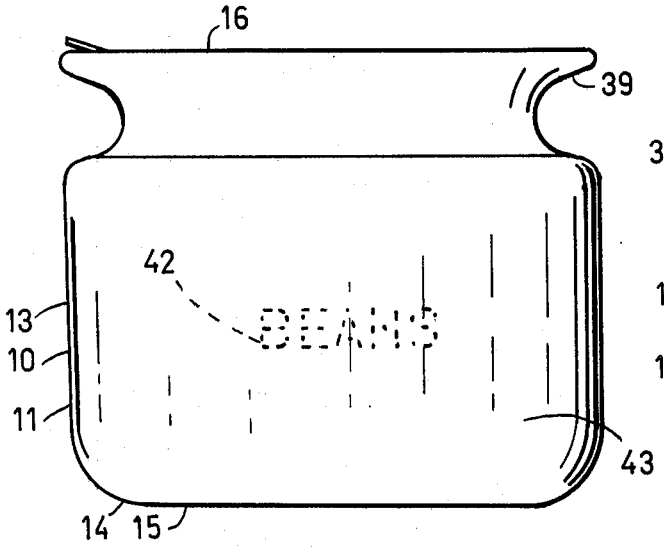
FIG. 1 is a side elevational view of a preferred embodiment of the invention.
Figure 3:
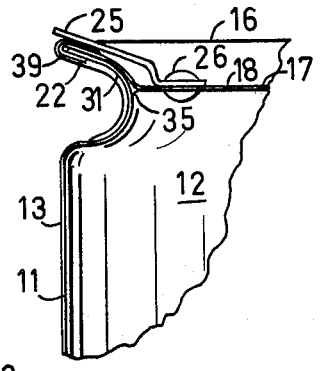
FIG. 3 is a sectional view in elevation showing a fragment at the closure end of the container.
Figure 2:
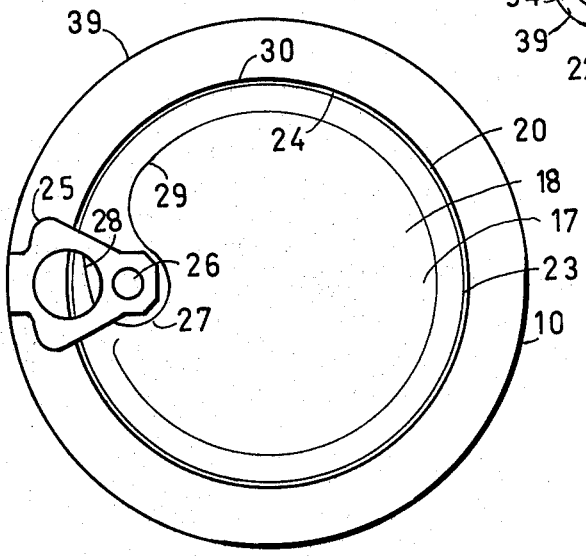
FIG. 2 is a top plan view of the container shown in FIG. 1.

Reference is now made to the preferred embodiment shown in FIGS. 1 through 4, and wherein the preferred embodiment of the disposable container is generally designated as 10. The container 10 has a metal portion 11 that defines an hermetically sealed chamber 12 in which the heatable food product is contained and preserved during storage. The body portion may be made of any suitable metal currently used in the container art such as rolled steel or aluminum and may be provided with a suitable internal coating where the nature of the food product provides a corrosive environment.

The body has a peripheral side wall section 13 that is joined at the lower end 14 of the container 10 with the bottom wall 15 of the body 11. The bottom wall 15 is integrally joined with the side wall section 13 and at the upper end 16 of the container, the container has a top wall section 17.

The top wall section 17 includes a center panel portion 18 of generally circular configuration and which defines the upper end 19 of the chamber 12. This center panel portion 18 serves as a removable closure for the container and is integrally joined along its perimeter 20 to an annular marginal portion 21 that is used in attaching wall section 17 to wall section 13 and in the formation of the annular lip 22 that will be described hereinafter.

Portions 18 and 21 of the top wall section 17 are integrally joined along a circular score line 23 at the base 24 of lip 22 and a conventional tear away metal closure structure is utilized in the embodiment. Thus center panel 18 is equipped with a finger manipulatable tab 25 which is fixed by a suitable fastener 26 or weld to the panel 18 at a point of encirclement by a score line 27 having an outer extension 28 that merges with the score line 23 at the perimeter of the panel and an inner extension 29 that is arcuate in nature and generally inwardly offset and parallel to score line 23. Thus by manipulating the tab to break the panel 18 along the score line 27 adjacent to the base of the tab 25, a border portion 30 of the panel 18 may be torn away as the panel is severed along score lines 27 and 23 to ultimately sever the panel 18 from the marginal portion 21 in a conventional manner.

The side wall section 13 in the illustrated embodiment has an annular end portion 31 which forms a part of the lip 22. Yet another part of the lip 22 is formed by the annular marginal portion 21 of the top wall section 17. These portions 31 and 21 generally surround the center panel portion 18 of section 17 and rise above the perimeter 20 to form the lip structure.

Figure 4:
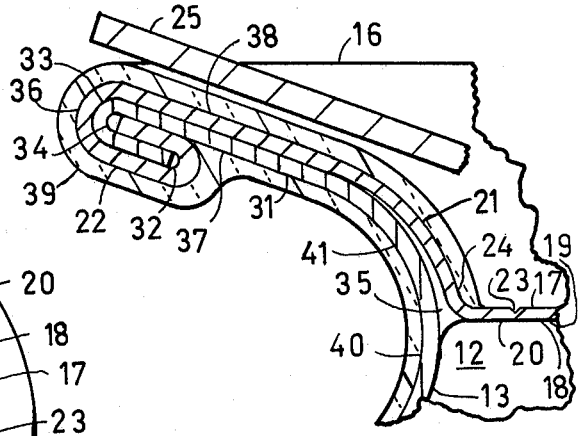
FIG. 4 is an enlarged view of a fragment of the container as seen in FIG. 3.

As seen in FIG. 4 end portion 31 is downturned at its end extremity 32 and the arrangement provides an endless edge 33 for the end portion 31. The annular marginal portion 21 is crimped over this edge 33 in fastening the top wall section 17 to the peripheral sidewall section 13. To facilitate the connection, the end extremity 34 of marginal portion 21 is further crimped around the end extremity of end portion 31 and the marginal portion 21 and the end portion 31 are further secured to provide the hermetic seal by soldering or other appropriate means as at 35. This arrangement of the lip structure 22 provides a brim that projects above the perimeter of the closure 18 and laterally of the side wall.

The brim or lip 22 has an endless or annular edge 36 with oppositely facing side surfaces 37 and 38. To restrict the exterior transmission of heat through the metal lip portion of the container when the contents are heated, suitable heat insulating material is applied to the lip and arranged to overlap the endless edge 36 and the oppositely facing surfaces 37 and 38 of the lip 22. This insulating material 39 may be in the form of an applied strip of insulation that overlays the surfaces or, alternatively, applied as a coating. Any suitable plastic material that is sufficiently heat resistant to the temperature encountered in heating the container contents and has a suitably low coefficient of heat transfer may be used including the foamed plastic materials that provide a cellular structure in the insulating covering.

In the embodiment illustrated the side wall section 13 has an annular groove or recess portion 40 which surrounds the closure 18. The outer surface 41 of this recess merges with the outer surface 37 of the brim or lip 22 and is also covered with the insulating material 39 to restrict the transmission of heat to the exterior from the metal surface 41. The recess 40 is of sufficient size to receive the fingers of a consumer of the product and so that the consumer can grasp the container by means of his fingers beneath the lip and in the recess area to manipulate the container when the contents are heated and without encountering excessive temperature conditions.

To facilitate the merchandising display of the container contents indicia 42 may be imprinted upon the exterior surface 43 of section 13 in the area generally intermediate the opposite ends 14 and 16, and except for this imprinted overlay of the container side walls, the side walls below the recess are generally barren of any overlay material to enable the container to be placed on a stove or appropriate source of heat so that the container contents may be heated to the desired temperature.

To heat and consume the contents, the consumer may first remove the closure forming center panel portion 18 by simply manipulating the tab 25 to sever the panel 18 along the score lines 23 and 27 and to ultimately sever the panel 18 from the marginal portion 21. The open container may then be placed upon a suitable heat source to heat the contents. When the contents are at the appropriate temperature, the container may be manipulated by placing the index finger and thumb of each hand beneath the lip in the recess area and the contents consumed without added utensils by raising the brim to the consumer's mouth in a conventional manner. The insulating material, of course, serves to protect the lips and fingers of the consumer from heat transmitted to the metal surfaces.

Figure 5:
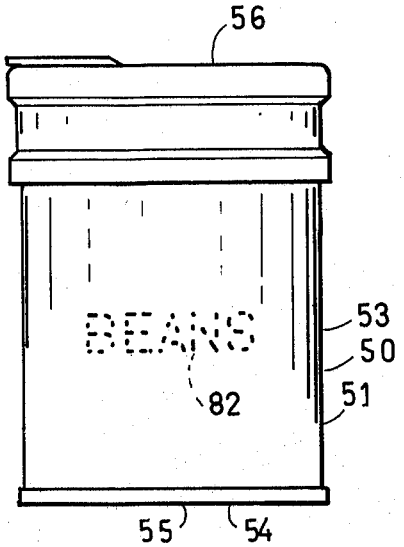
FIG. 5 is side elevational view of yet another embodiment of the invention.
Figure 6:
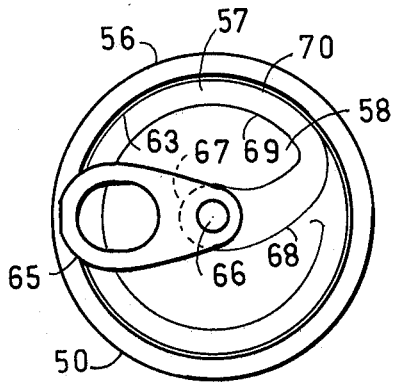
FIG. 6 is a top plan view of the embodiment shown in FIG. 5.
Figure 7:
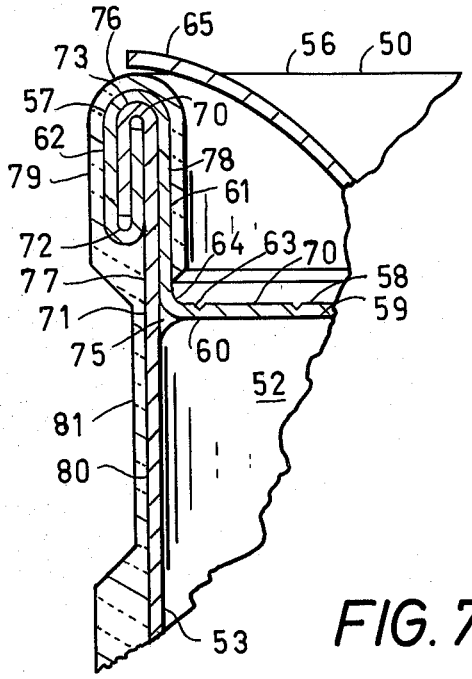
FIG. 7 is a sectional view in elevation of a fragment of the container seen in FIGS. 5 and 6, the view being enlarged to facilitate better understanding of the arrangement of the container parts.

Reference is now made to the embodiment shown in FIGS. 5 through 7 and wherein another container embodying principles of the invention is generally shown at 50. Container 50 also has a metal body portion 51 that defines an hermetically sealed chamber 52 in which the heatable food product is contained and preserved during storage. The body portion, like the previous embodiment, may be made of any suitable metal currently used in the container art and may also be provided with a suitable internal protective coating where the need arises.

The body 51 has a peripheral side wall section 53 that is joined at the lower end 54 of the container 50 with the bottom wall 55 of the body 51. The bottom wall 55 in this instance is secured to the side wall section 53 in a conventional manner as by crimping and appropriate sealing at the lower end of the container. At the upper end 56 of the container, the container has a top wall section 57.

The top wall section 57 includes a center panel portion 58 of generally circular configuration and which defines the upper end 59 of the chamber 52. Center panel 58 serves as a removable closure for the container and is also integrally joined along its perimeter 60 to an annular marginal portion 61 that is used in attaching wall section 57 to wall section 53 and in the formation of the annular lip 62 to be subsequently described.

Portions 58 and 61 of wall section 57 are integrally joined along a circular score line 63 at the base 64 of the lip 62, and a coventional tear away metal closure structure is utilized also in this embodiment. Thus center panel 58 is equipped with a finger manipulatable tab 65 which is fixed by a suitable fastener or weld 66 to the panel 58 at a point of encirclement by yet another score line 67. This score line has an outer extension 68 that merges with the circular score line 63 at the perimeter of the panel and it also has an inner extension 69 that is arcuate in shape and generally inwardly offset and parallel to score line 63. Thus by manipulating the tab to break the panel 58 along score line 67 adjacent to the base of the tab 65, a border portion 70 of panel 58 may be torn away as the panel is severed along score lines 67 and 63 and ultimately to sever the entire panel 58 from the marginal portion 61 in a conventional manner.

The side wall section 53 in the illustrated embodiment has an annular end portion 71 which forms a part of the lip 62. Yet another part of the lip 62 is formed by the annular marginal portion 61 of the top wall section 57. These portions 71 and 61 generally surround the center panel portion of section 57 and rise above the perimeter 60 to form the lip structure.

As seen in FIG. 7, end portion 71 is downturned at its end extremity 72 and the arrangement provides an endless edge 73 for the end portion 71. The annular marginal portion 61 is crimped over this edge 73 in fastening the top wall section 57 to the peripheral side wall section 53. To facilitate the connection, the end extremity 74 of marginal portion 61 is further crimped over the end extremity of end portion 71. The marginal portion 61 and end portion 71 are further secured to provide the hermetic seal by soldering or other appropriate means as at 75. This arrangement of the lip structure 62 provides a brim or lip that projects above the perimeter of the closure 58 in the container structure.

The brim or lip 62 has an endless annular edge 76 with oppositely facing side surfaces 77 and 78. To restrict the exterior transmission of heat through the metal lip portion of the container when the contents are heated, suitable heat insulating material 79 is applied to the lip 62 and arranged to overlap the endless edge 76 as well as the oppositely facing surfaces 77 and 78 thereof. This insulating material 79 may be in the form of an applied strip of heat insulating material that overlays the surfaces, or alternatively, applied as a fluid coating that sets to provide a continuous insulating covering on the surfaces 77 and 78. Again, any suitable synthetic plastic material that is sufficiently heat resistant to the temperatures encountered in heating the container contents and which has a suitable low coefficient of heat transfer may be used.

In the embodiment illustrated the insulation material 79 is extended downwardly to cover an annular outer surface 80 of the side wall section adjacent to closure and the material is provided with a recess 81 to facilitate grasping the container with the fingers. The recess again is adapted to receive the fingers in a manner similar to that previously described.

To facilitate the merchandising display of the container contents, indicia 82 may be imprinted upon the exterior surface 83 of side wall section 53 in the area below the insulated outer surface 80 and generally intermediate the opposite ends 54 and 56 of the container, and except for this imprinted overlay of the container side walls, the side wall below the insulated surface 80 are generally barren of any overlaying material so as to enable the container to be placed on a burner or appropriate heat source to heat the contents.

The disposable container 50 may be used in the manner similar to that described for the previous embodiment.

While only certain preferred embodiments of this invention have been shown and described by way of illustration, many modifications will occur to those skilled in the art and it is, therefore, desired that it be understood that it is intended herein to cover all such modifications as fall within the true spirit and scope of this invention.

I claim:

1. A disposable container for a heatable food product comprising a metal body that defines an hermetically sealed chamber for the food product, said body having upper and lower ends and being adapted at its lower end for placement on a stove or other heat source, an annular lip and a removable closure at said upper end, said closure having a perimeter and being surrounded at said perimeter by said lip, said lip being arranged to project above the perimeter of the closure and having oppositely facing surfaces, and insulating means covering said oppositely facing surfaces for protecting the lips of a consumer of the container contents from heat transmitted to said oppositely facing surfaces, said body having a peripheral side wall section with an annular recess portion that surrounds the closure at said upper end, said annular recess portion having an outer surface that merges with one of said oppositely facing surfaces, said recess portion being adapted to receive fingers of a person manipulating said container, and said insulating means additionally covering said outer surface of the annular recess portion for protecting such fingers of the person from heat transmitted to said outer surface.

2. A disposable container for use in the merchandising display, heating and consumption of a food product contained thereby comprising a metal body which defines an hermetically sealed chamber for the food product, said chamber having upper and lower ends, said body having a top wall section with an annular marginal portion and a center panel portion that defines said upper end, said panel portion having a perimeter, said body portion having a peripheral side wall section with an annular end portion, said annular end portion being crimped together to form an annular lip that surrounds the center panel portion and projects upwardly of the chamber at said perimeter, said marginal portion being integrally joined to said center panel portion along a score line at said perimeter of said center panel portion, said side wall section having an exterior surface and indicia imprinted and located thereon between said upper and lower ends, said lip having opposite sides, insulating means covering said opposite sides of said lip for protecting the lips of a consumer of the container contents from heat transmitted to said opposite sides, said body being adapted at said lower end of the chamber to receive and transmit heat to the contained food product in the chamber, and means attached to said center panel portion and manipulatable to sever said panel portion from the marginal portion along said score line, said wall section having an annular recess portion which surrounds said center panel portion at said upper end, said exterior surface including a surface portion located in said recess portion at one of said opposite sides, said insulating means additionally covering said surface portion, and said recess portion being adapted to receive fingers of a person manipulating said container.

* * * * *